US005967034A

United States Patent [19]

Baiada

[11] Patent Number: 5,967,034

[45] Date of Patent: Oct. 19, 1999

[54] METHOD AND DEVICE FOR DETECTING AND CONTROLLING THE PRINTING PRESSURE IN FLEXOGRAPHIC MACHINES

[75] Inventor: Carlo Baiada, Modena, Italy

[73] Assignee: Schiavi S.p.A., Milan, Italy

[21] Appl. No.: 09/047,037

[22] Filed: Mar. 24, 1998

[51] Int. Cl.[6] ..... B41F 13/00

[52] U.S. Cl. ..... 101/216; 101/484

[58] Field of Search ..... 101/216, 219, 101/153, 247, 484, 485, 351.1, 352.1; 73/862.55, 862.041, 774, 805

[56] References Cited

U.S. PATENT DOCUMENTS

| | | | |
|---|---|---|---|
| 2,333,962 | 11/1943 | Terry | 101/351 |
| 4,625,568 | 12/1986 | Hartung et al. | 73/862.55 |
| 4,782,753 | 11/1988 | Bolza-Schunemann | 101/363 |
| 5,630,363 | 5/1997 | Davis | 101/141 |

FOREIGN PATENT DOCUMENTS

| | | |
|---|---|---|
| 62-165135 | 7/1987 | Japan . |
| WO 92/07719 | 5/1992 | WIPO . |

*Primary Examiner*—J. Reed Fisher
*Attorney, Agent, or Firm*—Darby & Darby

[57] ABSTRACT

A method and a device for detecting and controlling the printing pressure for a flexographic machine having at least one printing group comprising first ink supply means, a second cylinder capable of removing a quantity of ink from said first supply means, a third cylinder rotatable and provided on its periphery with at least one covering element, the peripheral surface of which is defined by portions reproducing the motif to be printed, and a fourth cylinder defining, together with the third cylinder, a passage for the transit of a strip of material on which printing is to be performed; the cylindrical surface of the third cylinder has connected to it at least one sensor element for emitting signals proportional to the forces with which the sensor element itself is stressed during the course of contact of the portion of the third cylinder with the strip and with the second cylinder.

30 Claims, 2 Drawing Sheets

METHOD AND DEVICE FOR DETECTING AND CONTROLLING THE PRINTING PRESSURE IN FLEXOGRAPHIC MACHINES

BACKGROUND OF THE INVENTION

The present invention relates to a method and device for detecting and controlling the printing pressure, in particular, in flexographic machines.

As is known, flexographic printing machines are usually employed for performing printing, in one or more colours, on films of plastic material, paper or cardboard. For the application of each colour the flexographic machines are usually provided with a first rotating inking roll, or fountain roll, which is partially immersed inside a container with ink inside it, and a second rotating screened roll, or anilox cylinder, which is substantially tangential to the fountain roll and is able to remove at each rotation, during use, a given quantity of ink from the fountain roll itself, a third rotating plate-carrying roll, or plate cylinder, which is provided on its periphery with at least one printing plate, this plate consisting of lowered surface portions and raised surface portions reproducing the motif to be printed, being arranged substantially tangential to the anilox cylinder and capable, at each rotation, of retaining on the surface of the raised portions themselves a given quantity of ink supplied by the anilox cylinder, and a fourth printing roll, or impression cylinder, arranged substantially tangential to the plate cylinder and defining, together with the plate cylinder itself, a narrow passage intended for the transit of a strip of material on which printing is to be performed.

According to another embodiment of the known type, the fountain roll, the ink container and the anilox cylinder may be replaced by a group consisting of an ink container closed by doctor blades and an anilox cylinder which removes the quantity of necessary ink directly from the container.

The mutual distance existing between the plate cylinder and the impression cylinder is considered to be a particularly critical parameter since the result of the printing operation depends on this distance: if this distance differs appreciably from an optimum value, the printing operation performed is of mediocre quality. In practice, this distance may be modified, during operation of the flexographic machine, by temperature variations of the said cylinders, by wear of the cylinders themselves and by deformations in the structure which supports the cylinders themselves, and the optimum value of this distance varies with variation of the said strip of material and the subject to be printed.

In order to verify the printing quality it is known to use telecamera equipment. This equipment, however, in addition to being very costly, in the event of defective printing is unable to eliminate the cause of the malfunction, but merely indicates the malfunction itself to an operator.

In any case, the operator must modify manually the distance between the said cylinders by means of long and extremely critical operations which require a considerable amount of experience on the part of the operator him/herself, also because the procedures for carrying them out depend on the material on which the printing operations are performed and the design to be printed.

These manual adjustments are also required when at the start of a printing operation, for example with a new plate, the distances between the plate cylinder and the impression cylinder must be set.

A further cause of uncertainty able to prevent optimum operation-of the flexographic machines in question arises from the fact that the periphery of the said plate cylinder is defined by at least one printing plate which is fixed to the plate cylinder itself by means of thin bi-adhesive film. This film is subject to variations in thickness following temperature changes and also following the printing action of the cylinder, thereby influencing the printing quality.

A further critical parameter of the said printing machines is the distance which the anilox cylinder and the plate cylinder have between them, since correct inking of the plate also depends on this distance. It is obvious that these distances between the plate cylinder and impression cylinder and between the plate cylinder and anilox cylinder are influenced by too many variables and parameters which in practice are difficult to control.

Consequently, an idea which is proposed is that of changing the parameter on the basis of which detection and control are performed.

In fact, since it is difficult, if not impossible, to constantly control the optimum distance between the cylinders, the parameter "distance between the cylinders" has been replaced by the pressure existing between the plate cylinder and impression cylinder, namely, instead of controlling the position of the cylinders it is proposed to control directly the printing pressure.

Moreover, it is proposed to detect also the pressure existing between the plate cylinder and the anilox cylinder, namely the inking pressure.

In fact, it has been discovered that detection of the aforementioned pressures and controlling thereof within suitable values enable optimum-quality prints to be obtained.

In this way all the variables which modified in an unpredictable manner the distance between the plate cylinders and impression cylinder and anilox cylinder are overcome, since the printing pressure and the inking pressure are controlled directly, these being the parameters which influence most of all the printing quality.

The main problem to be solved with regard to the printing methods in flexographic machines of the known type consists in avoiding variations in the printing quality due to variations in the temperature conditions, the bi-adhesive film for fixing the plate, wear of the plate and wear of the flexographic machine itself and any other parameter which modifies the optimum printing conditions.

SUMMARY OF THE INVENTION

The solution to the problem is obtained by the features of the characterizing part of the first claim.

The solution to the problem provides a printing method for flexographic machines such that the operator is able to use easily at least one parameter for maintaining the optimum printing conditions. The parameter used is at least the printing pressure.

The solution to the problem provides, moreover, a device for detecting the printing pressure in flexographic machines.

The parameter of the printing pressure is obtained by providing the cylindrical surface of the said plate cylinder with at least one sensor element designed to emit electrical signals proportional to the force with which the sensor element itself is stressed during contact of the portion of the plate cylinder with which it is associated, with the strip adjacent to the impression cylinder.

According to a preferred embodiment, the method and the device also envisage detecting the force with which the sensor element itself is stressed during contact with the said anilox cylinder.

According to a further embodiment, the method and the device envisage using the signals from the sensor element in order to modify automatically the mutual position of the cylinders so as to keep the forces within the optimum values.

BRIEF DESCRIPTION OF THE DRAWINGS

Other advantages and technical features of the invention may be clearly understood from the contents of the claims indicated below and the detailed description which follows, provided with reference to the accompanying drawings which illustrate some purely exemplary and non-limiting embodiments thereof, in which:

DESCRIPTION OF THE PREFERRED EMBODIMENTS.

Figure 1:
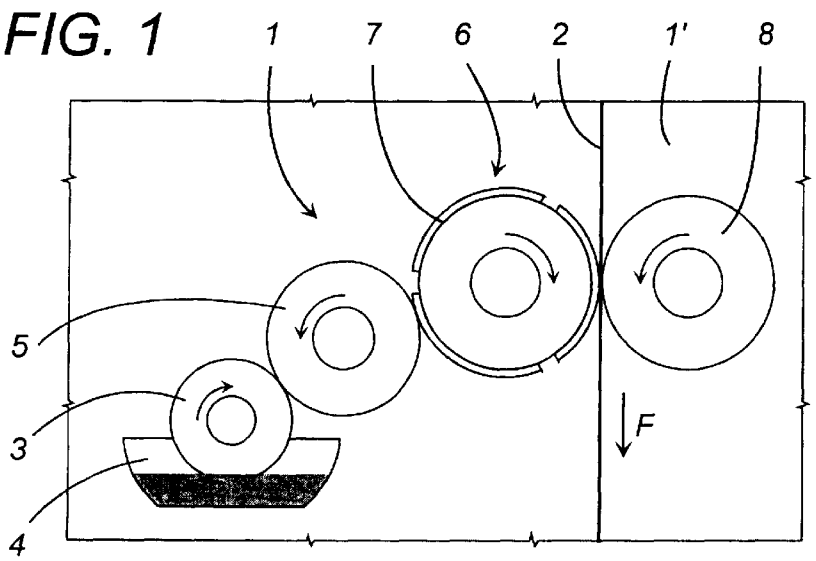
FIG. 1 shows in schematic form a front view of a portion of a flexographic machine realized in accordance with the present invention.

In accordance with the accompanying figures, and in particular FIG. 1, i1 denotes in its entirety a flexographic machine, only some of the components of which intended for the monochromatic printing of a strip 2 of material are shown in a schematic manner.

In the description which follows reference will be made to only the components necessary for carrying out monochromatic printing, it being obvious to a person skilled in the art that these components, in the case of multiple-colour printing, must be present for each colour present in the graphic motifs imprinted on the strip 2.

According to the embodiment shown in FIG. 1, the flexographic machine 1 comprises a fountain roll 3 partially immersed inside a container 4 with ink inside it and rotatable clockwise about a horizontal axis, an anilox cylinder 5 rotatable in an anti-clockwise direction, substantially tangential to the roll 3 and capable of removing, at each rotation, a quantity of ink from the roll 3 itself.

Figure 2:
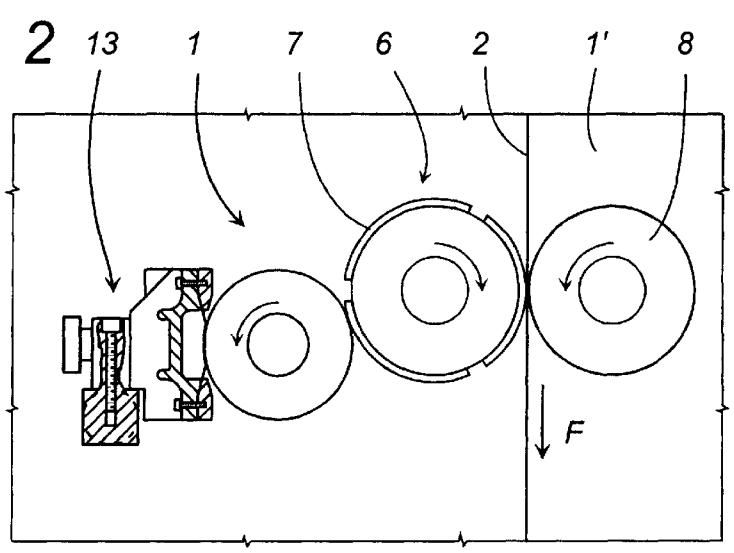
FIG. 2 shows schematically a front view of a portion according to a variant of the flexographic machine shown in FIG. 1.

Alternatively, according to the embodiment shown in FIG. 2, the flexographic machine 1 comprises an ink container 13 provided with doctor blades from which an anilox cylinder 5 rotatable in an anti-clockwise direction removes, at each rotation, a quantity of ink directly from the container 13 itself.

The flexographic machine 1 comprises moreover a plate cylinder 6 rotatable in a clockwise direction, substantially tangential to the cylinder 5 and provided on its periphery with a plurality (three in FIG. 1) of covering or plate elements 7, the peripheral surfaces of which are defined by lowered surface portions and by raised surface portions reproducing the motif to be printed. The cylinder 6 is capable during use, at each rotation, of retaining on the said raised surface portions a given quanity of ink supplied by the cylinder 5. The covering elements 7 are fixed to the cylinder 6, in a known manner, by means of a strip of bi-adhesive material not shown.

The flexographic machine 1 comprises moreover an impression cylinder 8 rotatable in an anti-clockwise direction, arranged substantially tangential to the cylinder 6 and defining, together with the cylinder 6 itself, a narrow passage intended for the transit, in a direction indicated by an arrow F, of the said strip 2 of sheet material on which printing is to be performed.

Figure 3:
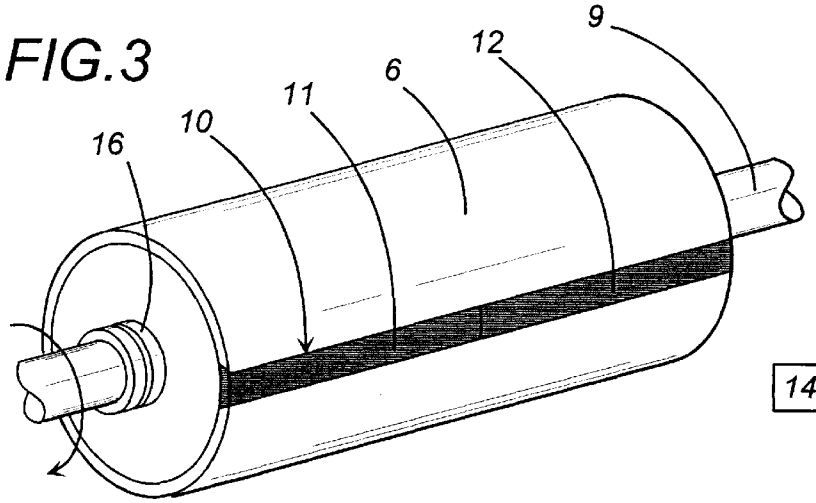
FIG. 3 shows schematically a prospective view of some details of the flexographic machine according to FIGS. 1 and 2.

In accordance with that shown in FIGS. 2 and 3, the cylinder 6 is keyed onto a horizontal shaft 9 and has formed on its cylindrical surface a recess 10 which extends in a direction parallel to the axis of the cylinder 6 itself and which preferably has a cross-section in the form of a "dovetail" with its vertex arranged on the outside of the cylinder 6. This recess 10 stably houses inside it two sensors 11 and 12 which are arranged respectively on the left-hand side and right-hand side in FIG. 2 and which are fixed inside the recess 10 for example by a resin filling material which surrounds it in a substantially complete manner. These sensors 11, 12 may be of any type able to provide a signal following application of a force to the sensors themselves and in particular may be of the piezo-resistive or piezo-electric type or may consist of strain gauges. The signal output by the sensors 11, 12 may be of any type and, in particular, of the electric or optical type.

Figure 4:
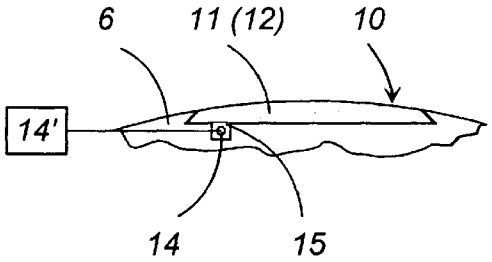
FIG. 4 shows a side view of some details of the flexographic machines according to FIGS. 1 and 2.

In accordance with that shown in FIG. 4, the sensors 11, 12 are connected to respective signal transmission cables 14 (only one of which is shown) which are housed inside a cavity 15 formed in an end wall of the recess 10 and are able to send the respective signals towards the outside of the cylinder 6 by means of a commutator 16 of the known type keyed onto the shaft 9.

According to two variants (not illustrated) of the present invention, the recess 10 may house inside it a number of sensors greater than two, or only one sensor.

Figure 5:
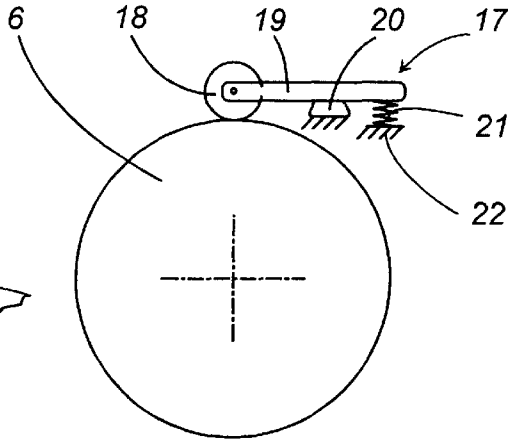
FIG. 5 shows a schematic elevation view of some details of the flexographic machines according to the preceding figures.
Figure 6:
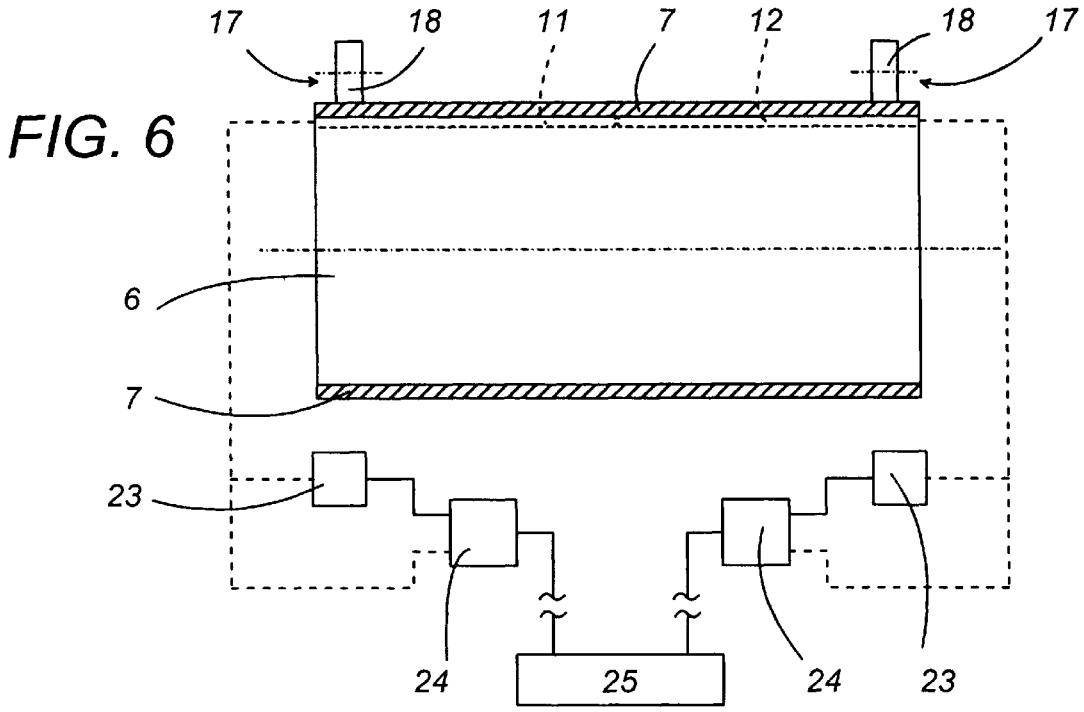
FIG. 6 shows a partially sectioned view of some details of the flexographic machines according to the preceding figures.
Figure 7:
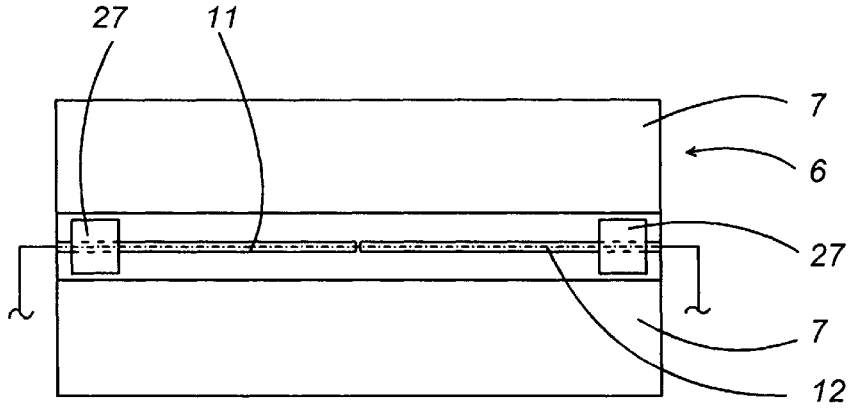
FIG. 7 illustrates a partially sectioned view of some details of a further embodiment of the flexographic machines forming the subject of the present invention.

According to a first embodiment, the sensors 11, 12 (see also FIG. 6) are covered by one of the covering elements 7 connected to the cylinder 6, while according to a further embodiment of the present invention, which will be considered below, the sensors 11, 12 are connected (FIG. 7) to a portion of the cylinder 6 itself adjacent to the zone situated between two contiguous covering elements 7. With reference, in particular, to FIGS. 5 and 6, each of the edge zones of the cylindrical surface of the cylinder 6 has arranged next to it a device 17 for activating the emission of a reference signal, functioning of which will be explained below.

Each device 17 comprises an idle roller 18 rotatable about an axis parallel to the axis of rotation of the cylinder 6 and having its cylindrical peripheral surface arranged in contact with a portion of the cylindrical peripheral surface of the cylinder 6 itself.

This roller 18 is supported by one end of a substantially horizontal bar 19, a middle portion of which is hinged on a fixed pivot 20 parallel to the axis of the cylinder 6 and the other end of which has a bottom portion adjacent to a top portion of a resilient element consisting of a helical spring 21 operating by means of compression, the other end of which rests against a fixed opposition element 22.

In accordance with that shown in FIG. 6 and as will become clear below, each of the sensors 11, 12 is connected to a respective memory device 23, of a type known per se, which is able to store, at each rotation of the cylinder 6, a reference signal emitted by the sensor 11, 12 itself when this sensor 11, 12 reaches a condition substantially in contact with a roller 18; an output of each memory device 23 is connected to an input of an associated comparator device 24, a second input of which is connected directly to the sensor 11, 12 and an output of which, in a simplified embodiment of the present invention, is connected, via elements, preferably of the electronic type, which are obvious to a person skilled in the art in the light of that stated in the present description, to a device 25 for displaying messages indicating characteristics of the signals from the comparator device 24 itself.

The signals which the sensor 11, 12 sends, at each rotation of the cylinder 6, to the associated memory device 23, and, respectively, to the associated comparator device 24 are proportional, as will emerge clearly below, to the force to which the sensor 11, 12 itself is subjected at different moments during operation of the flexographic machine 1.

During use, in accordance with the embodiment shown in FIG. 2, the container 13 constantly transfers ink to the peripheral surface of the cylinder 5; this cylinder 5 in turn transfers the ink to the covering elements 7 of the cylinder 6, which imprint in succession the motif to be printed on the strip 2, with cooperation of the cylinder 8 which presses the strip 2 itself against the cylinder 6.

During the course of each rotation of the cylinder 6, the sensors 11, 12 associated therewith make contact in succession, substantially, with the cylinder 5, the rollers 18 arranged next to the cylinder 6 itself, and the strip 2 adjacent to the cylinder 8. During the course of contact of the sensors 11, 12 with the rollers 18, the sensors 11, 12 themselves, which are subjected to compression with a known force depending on the characteristics of the helical springs 21, act as signal emitting elements and thus send a reference signal to the associated memory devices 23, which is retained by the memory devices 23 themselves and permanently sent to the associated comparator devices 24 until a following signal is received. Moreover, when the sensors 11, 12 come into the vicinity of the cylinder 5, they are compressed by means of the covering element 7 located next to them and send to the comparator device 24 respectively associated with them a corresponding signal which is a finction of the compression to which the sensors 11, 12 themselves have been subjected. Similarly, when the sensors 11, 12 come into the vicinity of the cylinder 8, they are compressed by means of the covering element 7 located next to them, and send to the associated comparator device 24 an associated signal which is a function of the compression to which the sensors 11, 12 have been subjected. It should be noted that the sensors 11, 12 subjected to compression emit respective signals porportional to the mean of the compressive forces applied to the various zones of the sensors 11, 12 themselves.

The reference signals arising from the described contact of the rollers 18 with the cylinder 6, at each rotation of the cylinder 6, are compared with those emitted when the condition of substantial contact of the sensors 11, 12 with the cylinders 5 and 8 is reached. As a consequence of that stated above, each comparator device 24, at each rotation of the cylinder 6, sends to the display device 25 four signals indicating the force with which the sensors 11, 12 have. been stressed by the portions of the cylinders 5 and 8 momentarily adjacent to them during the course of each operating cycle of the flexographic machine 1.

These signals are displayed, by means of the display device 25, for example in numerical form, and this information provides a useful aid for an operator in charge of adjusting the flexographic machine 1. On the basis of these signals, in fact, the operator is able to operate each of the two support elements 26 (FIG. 8) of each of the cylinders 5 and 6, varying in a manner known per se the positions of the cylinders 5 and 6 themselves and modifying the force with which the cylinders 5, 6 and 8 interact with one another.

In the case where the compression to which the sensors 11, 12 are subjected should differ excessively from a compression considered to be optimum, the comparator devices 24 could cause automatic stoppage of the flexographic machine 1.

In the said further embodiment of the present invention, in which the sensors 11, 12 are connected (FIG. 7) to a portion of the cylinder 6 adjacent to the zone located between two contiguous covering elements 7, the sensors 11, 12 themselves are covered by respective small plates 27 arranged in the vicinity of respective edge zones of the cylindrical surface of the cylinder 6; these small plates 27 are connected to the periphery of the cylinder 6 and have a thickness and a consistency substantially the same as those of the covering elements 7.

These small plates 27 are affected by the action of the said rollers 18 in the manner described above and act on the sensors 11, 12 in a manner similar to that considered above so as to subject the sensors 11, 12 themselves to compression during the course of contact of the small plates with the peripheral cylindrical surface of the cylinder 5 and with the strip 2 adjacent to the cylinder 8. The signals from the sensors 11, 12 are used in the manner described above.

Figure 8:
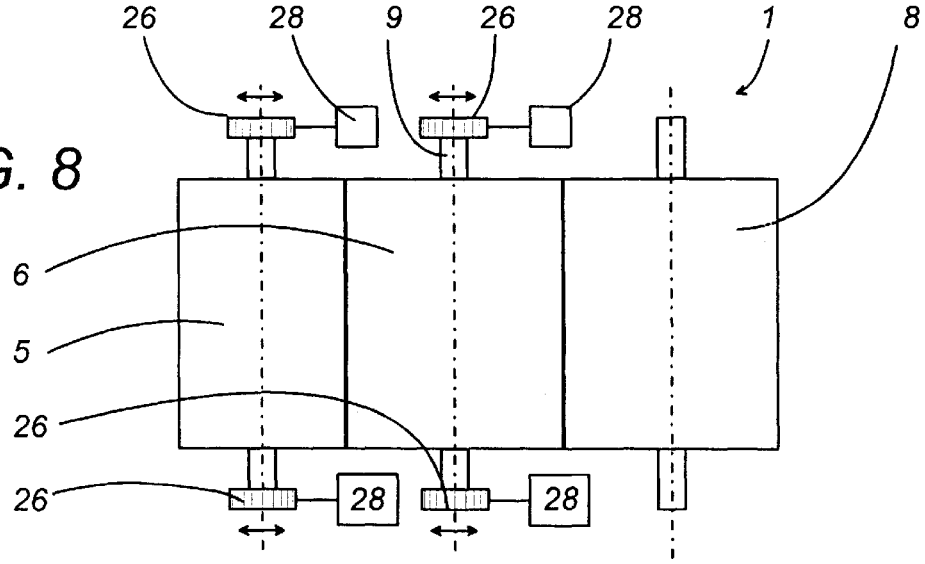
FIG. 8 shows schematically a plan view of part of a flexographic machine forming a variant of the flexographic machines according to FIGS. 1 to 7.

FIG. 8 shows a further embodiment of the flexographic machine I considered above.

In this embodiment of the flexographic machine 1, the support elements 26 of the cylinders 5 and 6 are supported in a manner not shown by the base 1' of the flexographic machine 1 and are able to translate horizontally either way, in a direction perpendicular to the axis of the cylinder 6, under the action of the respective actuating elements 28 subject to the control of the said comparator devices 24.

During use, in the case where a comparator device 24, following the comparison between a reference signal from a memory device 23 and the signal from one of the sensors 11, 12 associated with the memory device 23 itself, should encounter an excessive divergency between an optimum compression value and the compression to which the sensor 11, 12 itself is subjected, for example, during contact between the cylinder 7 and the cylinder 8 (with the strip 2 arranged in between), the actuating element 28 associated with the support element 26 of the cylinder 6 situated on the same side as the sensor 11, 12 causes horizontal translation of the support element 26 itself so as to regulate the compression in question.

The same applies to the other sensor 11, 12 and to the other support element 26 of the cylinder 6, and with similar procedures the comparator devices 24 respectively associated with the sensors 11, 12 ensure that the support elements 26 of the cylinder 5 are kept in optimum positions.

It should be noted that, according to variants, not shown, of the flexographic machine 1, the sensors 11 and 12 could have any form and extension and could be arranged in positions not coinciding with a generatrix of the cylinder 6.

It should be noted, moreover, that the signals from the sensors 11 and 12 could be sent to the comparator devices 24 without the use of the said commutator 16; these signals, for example, could be sent to the comparator devices 24 via radio or in the form of signals of the optical, acoustic or any other type suitable for the purpose, by means of a transmitter device schematically shown in the form of a block 14' associated with the wires 14 (FIG. 4).

It should be noted, finally, that the said devices 17 could be omitted, with the said reference signals being able to be emitted by signal emitter devices of the known type, not shown.

The invention thus conceived may be subject to numerous modifications and variations, all of which falling within the scope of the inventive idea. Moreover, all the details may be replaced by technically equivalent elements.

What is claimed:

1. A method to control operation of a flexographic machine to transfer ink from a supply to a strip on which printing takes place, comprising:

rotating a first cylinder that receives ink from the supply;

rotating a second cylinder having a plate to make the impression with rotating compressive contact between the peripheral surfaces of said first and second cylinders for said second cylinder to receive the ink from said first cylinder;

rotating a third compression cylinder with the strip on which the printing is to take place passing between said second and third cylinders and with compressive force between the peripheral surfaces of said second and third cylinders;

directly sensing with a sensor element located along a substantial portion of the length of said second cylinder the compressive force between the peripheral surfaces of said second cylinder and at least one of said first and third cylinders; and producing a signal corresponding to the compressive force that is sensed.

2. Method according to claim 1, further comprising the step of controlling in response to said signal the compressive force acting on said second cylinder via means acting on at least one of said first and third cylinders to keep the compressive force acting on said second cylinder within two predetermined optimum values.

3. Method according to claim 1, wherein the sensing step comprises:

detecting respective first and second compressive forces existing between the cylindrical peripheral surface of said first and second cylinders and said second and third cylinders by means of at least said sensor element to provide said first and second signals proportional to said first and second compressive forces; and displaying said first and second signals to provide an indication of said first and second compressive forces.

4. Method according to claim 3, further comprising the step of controlling in response to at least one of said first and second signals said compressive force acting on said second cylinder via means acting on at least one of said first cylinder and said third cylinder to keep said compressive force within two predetermined optimum values.

5. Method according to claim 3, wherein said first and second compressive forces are cyclically detected by the same sensor element.

6. Method according to claim 4, wherein controlling step comprises controlling said first compressive force between said first cylinder and second cylinder and said second compressive force between said second cylinder and said third cylinder automatically in response to said first and second signals.

7. A flexographic machine operating to transfer ink from a supply to a strip on which printing takes place, comprising:

a first rotatable cylinder receiving ink from the supply;

a second rotatable cylinder having a plate to make the impression, the peripheral surface of said second cylinder being in rotating compressive contact with the peripheral surface of said first cylinder to receive the ink therefrom;

a third rotatable cylinder compression cylinder, the strip on which the printing is to take place passing between said second and third cylinders with compressive force existing between the rotating peripheral surfaces of said second and third cylinders;

a sensor located along a substantial portion of the length of said second cylinder to sense the compressive force in a direction along the length of said second cylinder between the peripheral surface of said second cylinder and at least one of said first and third cylinders and produce a signal corresponding thereto.

8. Flexographic machine according to claim 7, wherein the signal from said sensor is of the electric type.

9. Flexographic machine according to claim 1, wherein the signal from said sensor is of the optical type.

10. A flexographic machine as in claim 7 further comprising means responsive to said signal for producing an indication of the measured compressive force.

11. A flexographic machine as in claim 7 further comprising a signal pickup which picks up the signal from said sensor once per each rotation of said second cylinder.

12. A flexographic machine as in claim 7 wherein said sensor measures the compressive force between said second cylinder and each of said first and third cylinders and produces a respective first and second signal representative of said two measurements.

13. A flexographic machine as in claim 12 wherein said sensor comprises respective first and second sensors for producing said first and second signals.

14. A flexographic machine as in claim 12 further comprising an indicating means for indicating the respective measured forces corresponding to said first and second signals.

15. A flexographic machine as in claim 12 further comprising a signal pickup which picks up the respective first and second signals once per each rotation of said second cylinder.

16. A flexographic machine as in claim 12 wherein there is a single sensor which produces both said first and second signals.

17. A flexographic machine as in claim 7 wherein said second cylinder has a cavity on its surface in a direction along the cylinder length and said sensor is located in said cavity.

18. A flexographic machine as in claim 17 further comprising a covering for said cavity in communication with said sensor which is stressed with the compressive force to convey the compressive force to said sensor.

19. A flexographic machine as in claim 17 wherein said cavity is parallel to the longitudinal axis of said cylinder.

20. A flexographic machine as in claim 13 wherein said second cylinder has two cavities along its length, one for each of said first and second sensors.

21. A flexographic machine as in claim 1 further comprising means for producing a reference signal of a characteristic of said second cylinder and means for comparing said signal from said sensor with said reference signal.

22. Flexographic machine according to claim 21 wherein said means for producing said reference signal comprises said sensor.

23. Flexographic machine according to claim 22, wherein said means for producing said reference signal further comprises activating means acting relative to said sensor, an idle roller rotatable about an axis parallel to the axis of rotation of said second cylinder and having its cylindrical peripheral surface arranged in contact with a portion of the cylindrical peripheral surface said second cylinder, and resilient means exerting a given force against said roller and against the cylindrical peripheral surface of said second cylinder.

24. Flexographic machine according to claim 12 further comprising:

means for producing a reference signal of a characteristic of said second cylinder;

comparator means for comparing said first and second signals and said reference signal; and display means for displaying messages indicating characteristics of the output of said comparator means.

25. Flexographic machine according to claim 24, wherein said second cylinder has two sensors arranged alongside one another in a direction parallel to the axis of rotation of said second cylinder; each sensor element having an associated comparator means to send to said display means signals proportional to the signals from the respective sensor element.

26. Flexographic machine according to claim 24 further comprising adjustable support means for each of said first cylinder and said second cylinder in the vicinity of each of the respective axial ends thereof, the positions of which are adjustable with respect to a base of the flexographic machine itself, and actuating means responsive to the output of a said comparator means to adjust the positions of at least part of said support means of at least one of said cylinders.

27. Flexographic machine according to claim 26, wherein the support means of said first and second cylinders are adjustable independently of one another.

28. Flexographic machine according to claim 26, wherein the support means of said second cylinder are adjustable independently of one another.

29. Flexographic machine according to claim 24, further comprising a commutator associated with a shaft supporting said second cylinder to send to said comparator means the signals from said sensor elements.

30. Flexographic machine according to claim 8, further comprising a transmitter to send to said comparator means said signals from said sensor.

* * * * *

UNITED STATES PATENT AND TRADEMARK OFFICE

CERTIFICATE OF CORRECTION

PATENT NO. : 5,967,034

DATED : October 19, 1999

INVENTOR(S) : Carlo BAIADA

It is certified that errors appear in the above-identified patent and that said Letters Patent is hereby corrected as shown below:

On the Title Page:

Please add

--[30] Foreign Application Priority Data

Mar. 28, 1997 Europe ..... 97830156.2 --.

Signed and Sealed this

Third Day of April, 2001

*Attest:*

NICHOLAS P. GODICI

*Attesting Officer*

*Acting Director of the United States Patent and Trademark Office*